US005738549A

United States Patent [19]

Laquerbe

[11] Patent Number: 5,738,549

[45] Date of Patent: Apr. 14, 1998

[54] ELECTRICAL CONNECTOR WITH TERMINAL RETENTION MEMBER AND BRIDGING CONTACTS

[75] Inventor: Jacques Laquerbe, Sartrouville, France

[73] Assignee: The Whitaker Corporation, Wilmington, Del.

[21] Appl. No.: 674,386

[22] Filed: Jul. 3, 1996

[30] Foreign Application Priority Data

Jul. 11, 1995 [FR] France ..... 95 08374

[51] Int. Cl.[6] ..... H01R 11/09

[52] U.S. Cl. ..... 439/724; 439/509

[58] Field of Search ..... 439/188, 507, 439/509, 595, 596, 597, 724

[56] References Cited

U.S. PATENT DOCUMENTS

| | | | |
|---|---|---|---|
| 4,954,093 | 9/1990 | Nadin | 439/507 X |
| 5,041,017 | 8/1991 | Nakazato et al. | 439/509 |
| 5,201,667 | 4/1993 | Endo et al. | 439/509 X |

*Primary Examiner*—Khiem Nguyen
*Attorney, Agent, or Firm*—Bradley N. Ditty

[57] ABSTRACT

A connection assembly comprises a receptacle connector and a pin header connector. Secondary locking housings are provided to block the locking lances in a securely locked position. The secondary locking housing of the pin header connector has pin bridging contacts mounted therein. Inclusion of the locking assurance and bridging functions in the secondary locking housing insures a cost-effective and reliable design.

7 Claims, 9 Drawing Sheets

ELECTRICAL CONNECTOR WITH TERMINAL RETENTION MEMBER AND BRIDGING CONTACTS

BACKGROUND OF THE INVENTION

1. Field of the Invention

This invention relates to an electrical connector having a first housing with terminals retained therein, and a second member for insuring secure locking of the terminals to the housing. The second member may comprise bridging contacts for short circuiting some of the terminals.

2. Description of the Prior Art

It is common to find electrical connectors comprising an insulative housing having a plurality of terminal receiving cavities and integral retention lances for locking electrical terminals in these cavities. Certain connectors comprise a further cap member, or secondary housing, that locks the retention lances in the retaining position for a more secure retention of terminals in the housing.

In certain applications, certain terminals receive a common power or electrical signal supply and should therefore be interconnected by a bridging element (i.e. short circuited).

It is also a continuous requirement to provide more compact and cost effective connection assemblies that may incorporate features such as the above mentioned, whilst nevertheless remaining reliable.

SUMMARY OF THE INVENTION

It is an object of this invention to provide a compact and cost-effective connector assembly that securely locks terminals in a connector housing, and enables bridging of some of the terminals.

Objects of this invention have been achieved by providing an electrical connector assembly comprising a receptacle connector having an insulative housing and a plurality of receptacle terminals mounted therein, the receptacle terminal further comprising a secondary locking housing that acts as a terminal locking assurance member, the secondary housing having short circuiting contacts mounted thereto. In an advantageous embodiment, the short circuit contacts may comprise stamped and formed pin contacts extending from opposing sides of a base section. The bridging contacts could be mounted to the secondary housing by overmoulding of the secondary housing to the bridging contacts. Other features of the invention are described in the claims.

DETAILED DESCRIPTION OF THE PREFERRED EMBODIMENT

Figure 1:
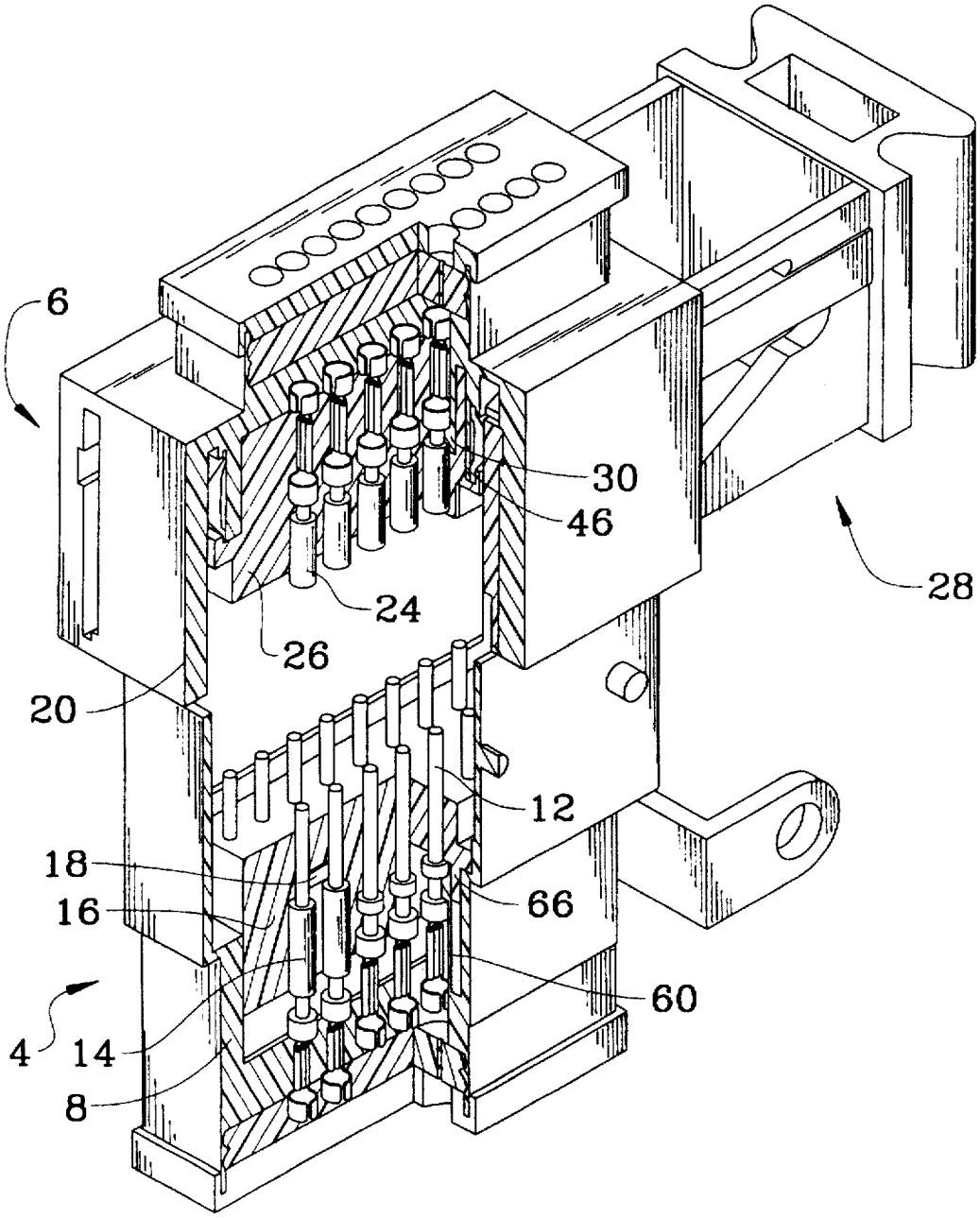
FIG. 1 is an isometric partially cut-away view of a connection assembly according to this invention.
Figure 2:
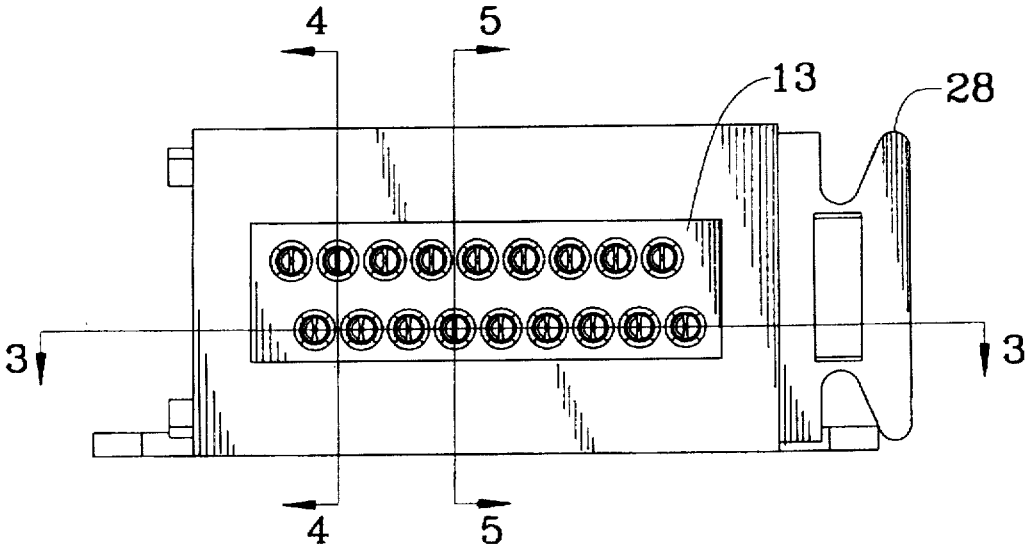
FIG. 2 is a bottom view of the connection assembly of FIG. 1.

Referring to FIGS. 1–5, an electrical connection assembly 2 comprises a first pin header connector 4 and a second receptacle connector 6. The pin header connector 4 comprises an insulative housing 8 having a plurality of cavities 10 extending therethrough between a terminal receiving end 13 and a mating end 15 of the housing, and terminals 12,14 received in the cavities 10. Some of the terminals 12 are pin terminals and some are receptacle terminals 14 for bridging with bridging contacts. The pin header connector further comprises a secondary housing 16 mounted against the mating face 15 and having bridging contacts 18 mounted thereto.

The receptacle connector 6 comprises an insulative housing 20 having a plurality of cavities 22 extending between a terminal receiving end 23 and a mating end 25 of the housing, the connector further comprising receptacle terminals 24 received within the cavities 22. The receptacle connector 6 further comprises a secondary housing 26 mounted proximate the mating face 25. The receptacle connector further comprises a camming slide mechanism 28 for resisting coupling of the connectors 4,6 together.

Figure 24:
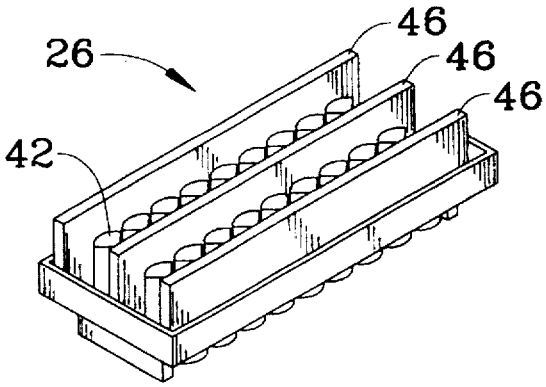
FIGS. 25 and 24 are isometric views of the secondary housing of FIG. 20.
Figure 25:
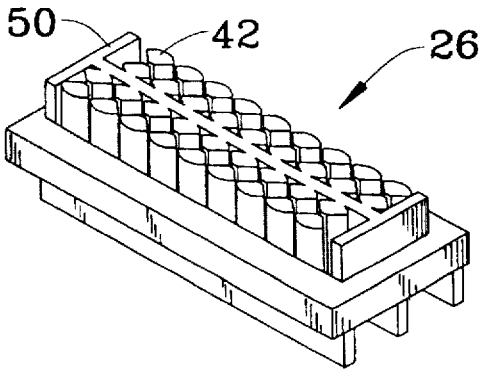

Referring now to FIG. 16–19, the receptacle connector housing 20 is shown. Within the terminal receiving cavity 22, there are flexible locking lances 30 having locking protrusions 32 projecting into the cavity for locking behind a shoulder of the receptacle terminal thereby retaining the terminal within the cavity. The free ends 34 of the locking lances 30 are disposed well below the mating surface 25. Flanking lateral sides of the lances 34 are upstanding wall portions 36 extending up to the mating face 25 and having recesses 38 for guiding and positioning the receptacle terminal 24 within the cavity 22. Between the wall portions 26 there is a gap 40 within which (see FIGS. 24,25) complementary wall portions 42 of the receptacle secondary housing 26 interleaves thereby enclosing the terminal 24 fully within the cavity area 38. The gap 40 between wall portions 36 facilitates manufacturing of the housing 20 by injection moulding, in particular by providing access by a moulding die pin to form the locking lance's protrusion and free end 32,34 from the mating side 25.

Slots 44 are provided along side each row of locking lances 32, the locking lances biasable into the slot areas during insertion of the terminal into the cavity 22. Once all of the terminals 24 have been fully mounted to the housing 20, the secondary housing 26 is fully mounted. Referring to FIGS. 20–25, the secondary housing comprises lance backup walls 46 that are inserted into the slots 44 and serve to prevent outward biasing of the locking lances 30, thereby insuring secure retention of the receptacle terminals within the housing 20. If a receptacle terminal has been poorly mounted, and a locking lance 30 is outwardly biased, the wall portion 46 abuts the free end 34 of the locking lance thereby preventing full mounting of the secondary housing 26 to the housing 20. The latter ensures detection of incorrect assembly of terminals to the housing 20. Due to inter-engagement of the wall portions 42 with the wall portions 36 of the housing 20, a mating surface 50 of the secondary housing 26 is flush with the mating surface 25 of the housing 20 when fully mounted thereto. The latter ensures a compact assembly.

Figure 3:
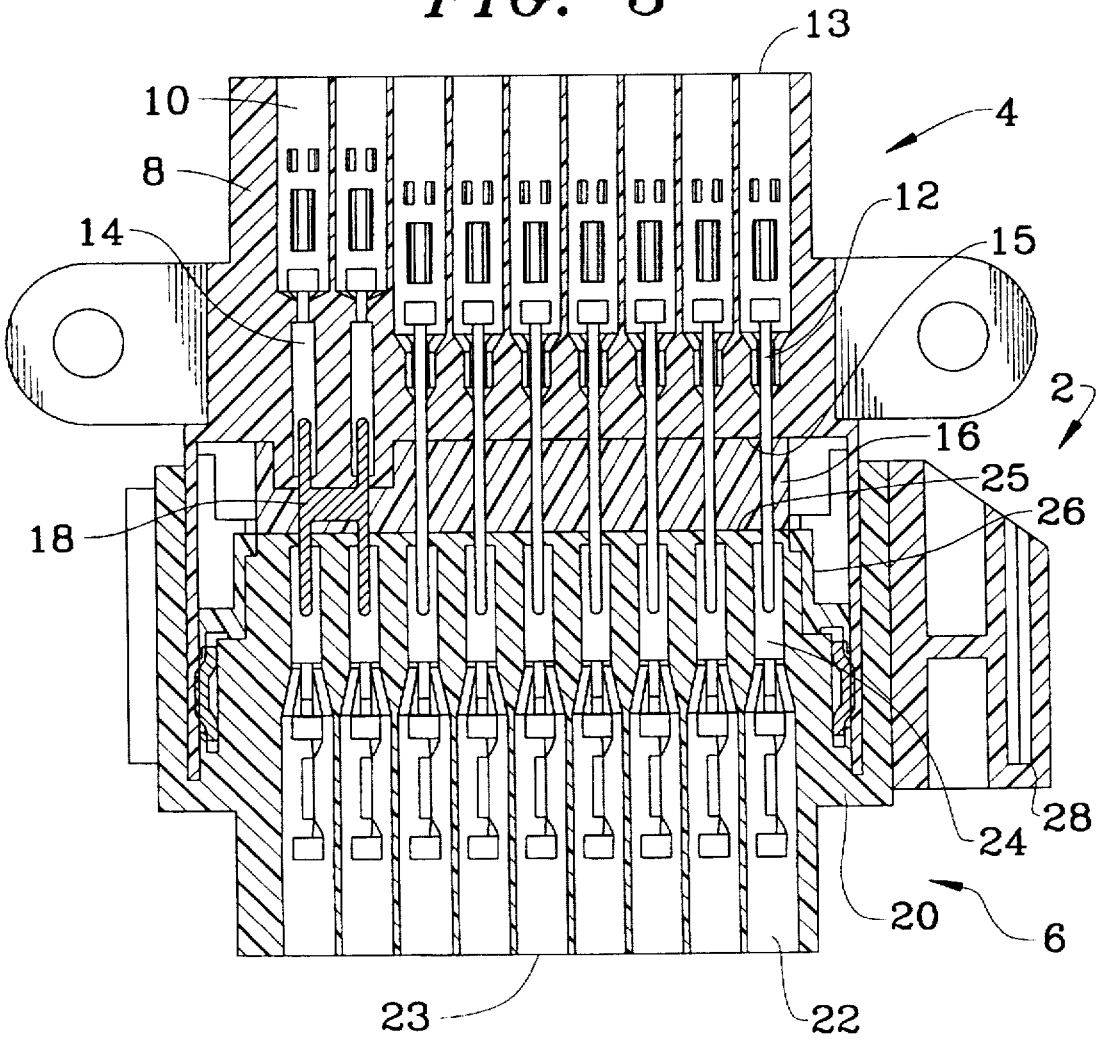
FIG. 3 is a cross-sectional view through lines 3—3 of FIG. 2.
Figure 4:
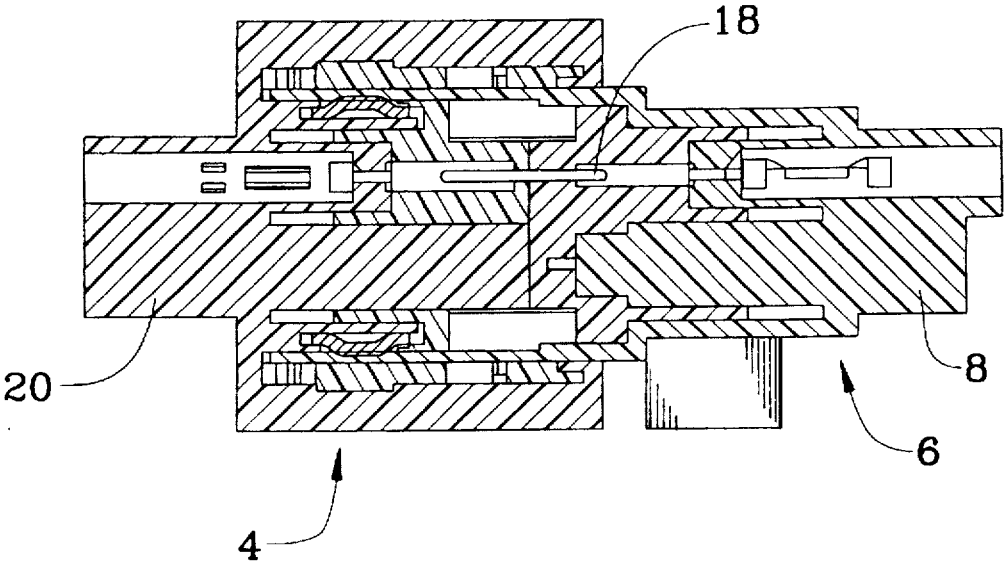
FIG. 4 is a cross-sectional view through lines 4—4 of FIG. 2.
Figure 5:
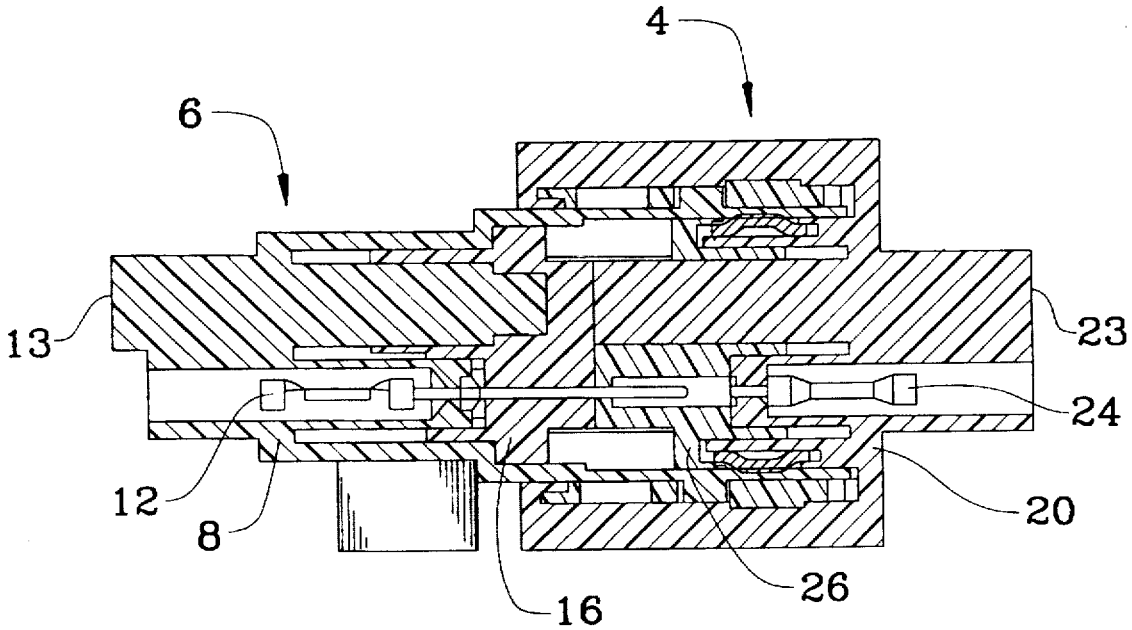
FIG. 5 is a cross-sectional view through lines 5—5 of FIG. 2.
Figure 6:
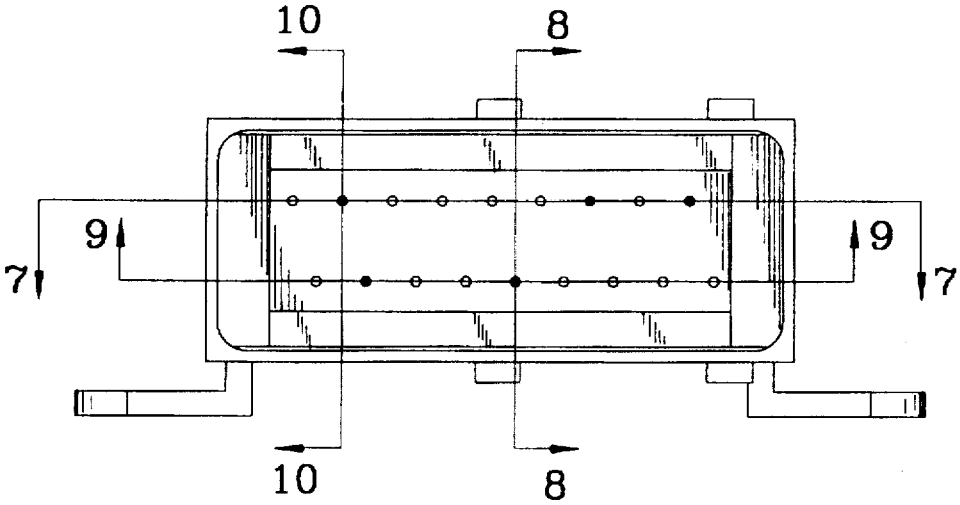
FIG. 6 is a view in the direction of the mating face of a header connector forming part of the connection assembly of FIG. 1.
Figure 7:
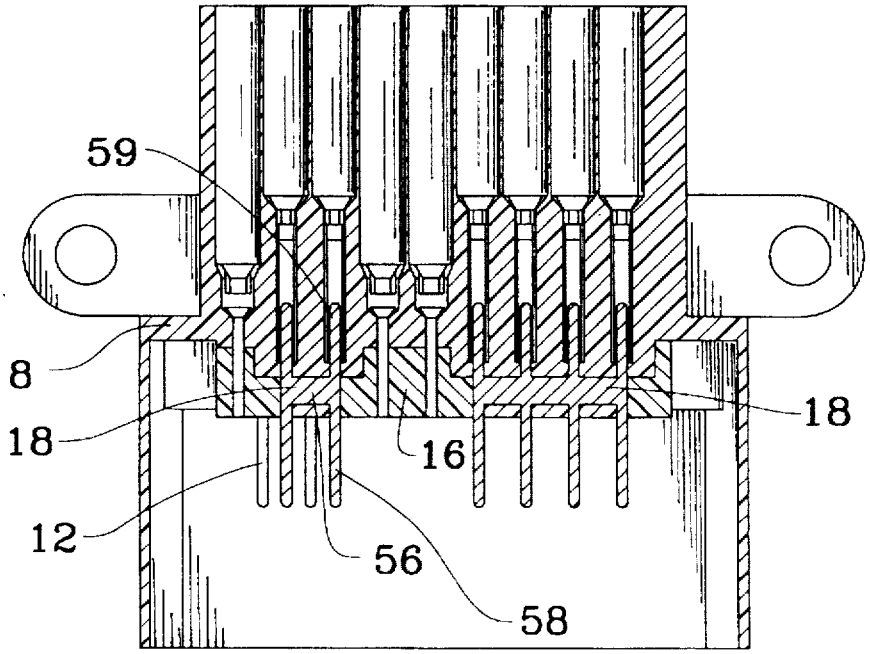
FIG. 7 is a cross-sectional view through lines 7—7 of FIG. 6.
Figure 8:
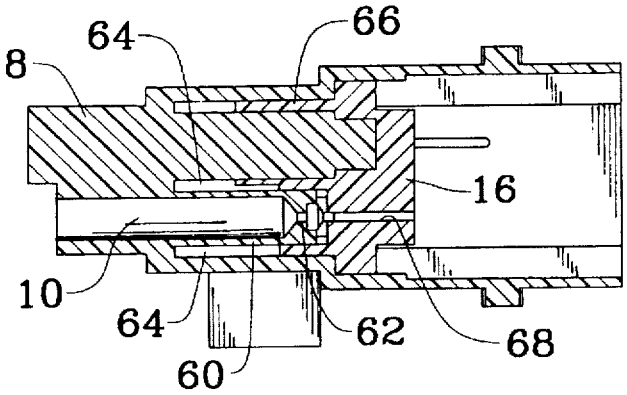
FIG. 8 is a cross-sectional view through lines 8—8 of FIG. 6.
Figure 9:
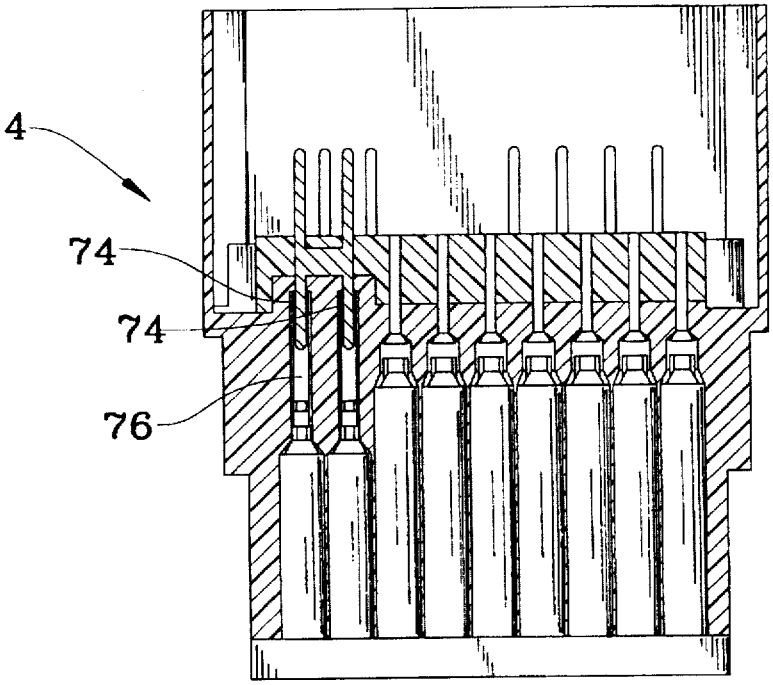
FIG. 9 is a cross-sectional view through lines 9—9 of FIG. 6.

Referring now to FIGS. 6–10, part of a plug connector is shown (terminals are not mounted therein). Some of the cavities 10 are for receiving pin terminals 12, where other cavities are for receiving receptacle terminals 14 as shown in FIG. 3. Referring to FIG. 7, the receptacle terminals are positioned for plugging contact with bridging terminals 18 that comprise a base portion 56 and pin contact portions 58,60 extending in opposing directions from the base portion 56. The bridging contact 18 is mounted to the secondary housing 16 by overmoulding the housing over the base portion 56 of the bridging contacts.

The mating portions 58 of the pin contacts 18 are for coupling with receptacle terminals 24 of the receptacle connector 6, and serve to short circuit some of the receptacle terminals to some of the terminals in the first connector 4. In certain applications this short circuiting, or bridging, is required because a signal or power conductor of a harness must supply two or more different conductors of a device.

The bridging contacts 18 can be manufactured by stamping and forming from sheet metal in a continuous strip, which is cut to the desired length having the required number of pin contacts for bridging.

In a similar manner to the receptacle connector housing 20, the pin connector housing 8 has locking lances 60 having locking protrusions 62 projecting into the cavity 10 for locking the pin terminals therein. The locking lances 60 are resiliently biasable into slots 64 within which corresponding lance back-up walls 66 of the secondary locking housing 16 are inserted once all of the pin terminals have been fully mounted, thereby blocking the locking lances. The latter ensures secure retention of the pin terminals within the cavities 10.

Figure 10:
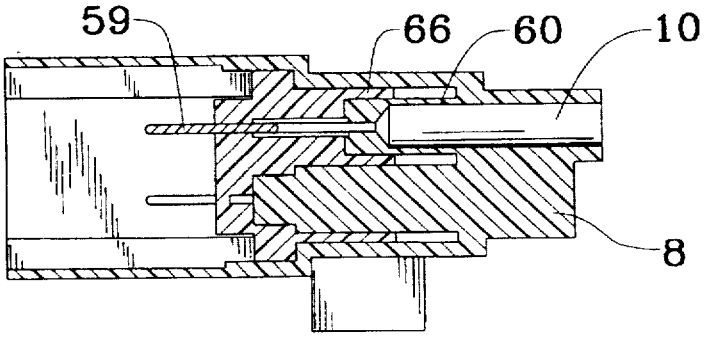
FIG. 10 is a cross-sectional view through lines 10—10 of FIG. 6.
Figure 11:
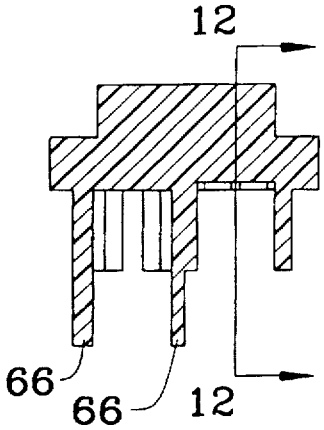
FIG. 11 is a cross-sectional view through a secondary housing of the pin header connector of FIG. 6.
Figure 12:
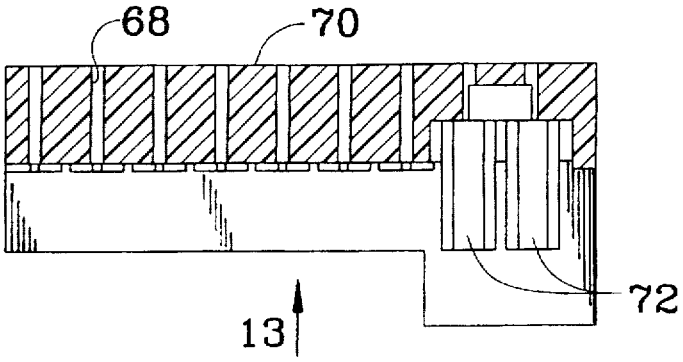
FIG. 12 is a cross-sectional view through lines 12—12 of FIG. 11.
Figure 13:
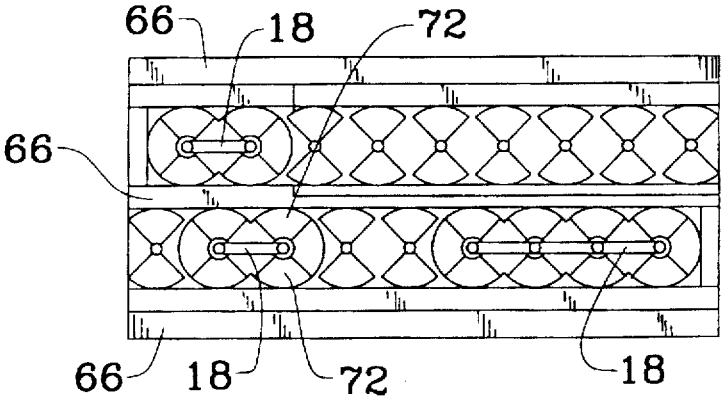
FIG. 13 is a view in the direction of arrow 13 of FIG. 12.
Figure 14:
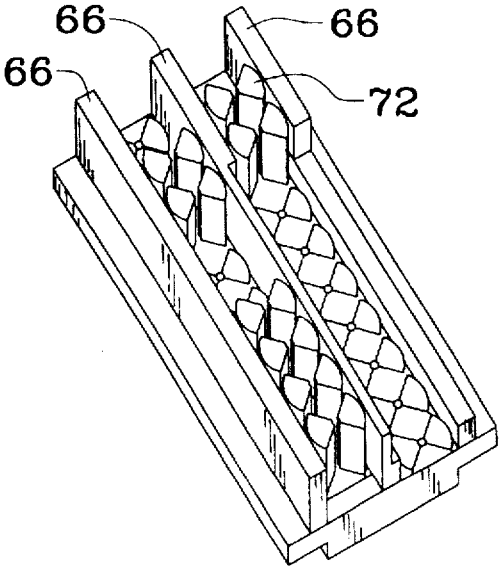
FIGS. 14 and 15 are isometric views of the secondary housings of FIG. 11.
Figure 15:
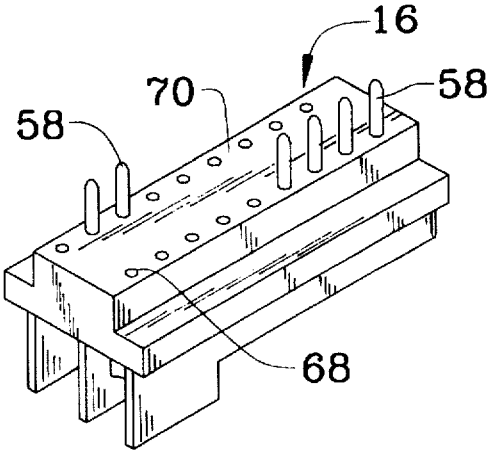
Figure 16:
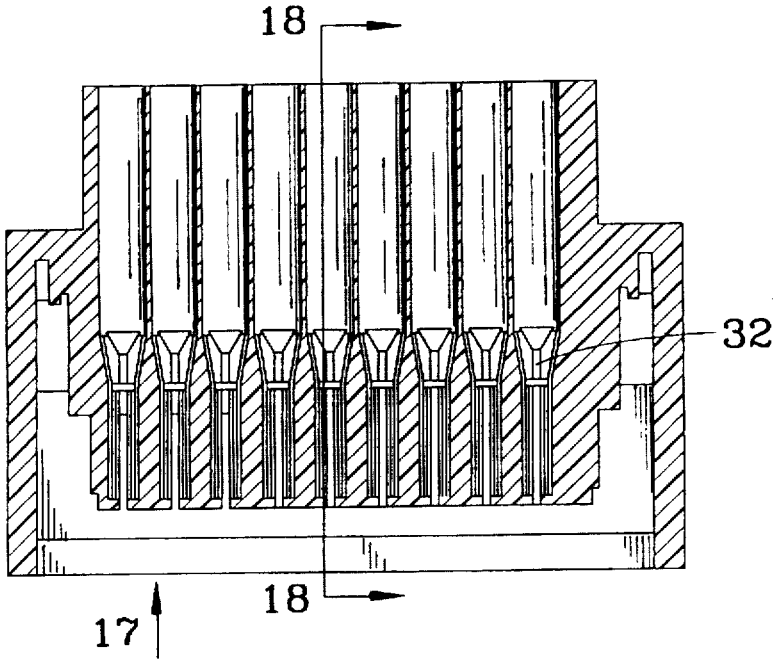
FIG. 16 is a cross-sectional view through a receptacle housing of the connection assembly.
Figure 17:
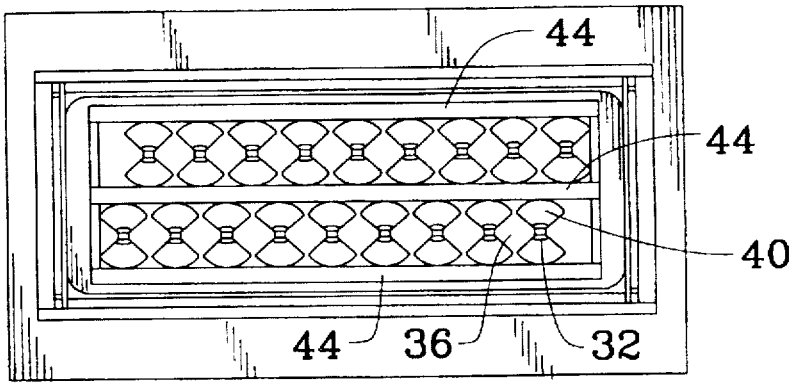
FIG. 17 is a view in the direction of arrow 17 of FIG. 16.
Figure 18:
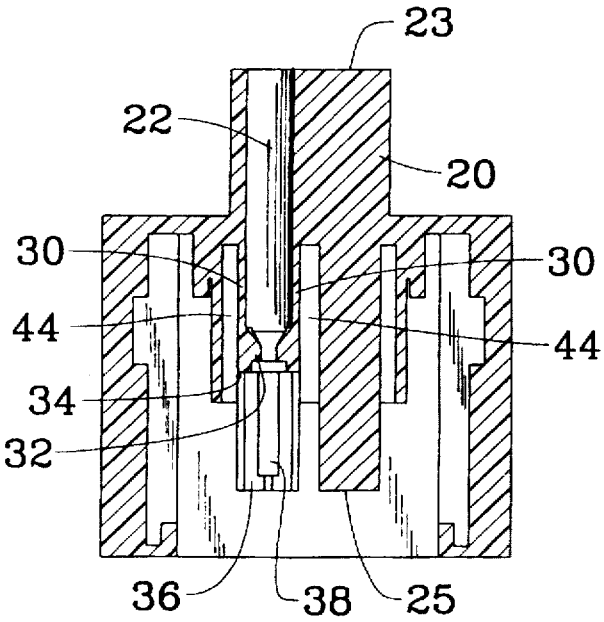
FIG. 18 is a cross-sectional view through lines 18—18 of FIG. 16.
Figure 19:
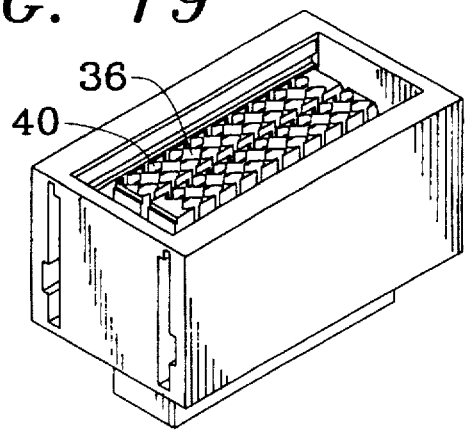
FIG. 19 is an isometric view of the housing of FIG. 16.
Figure 20:
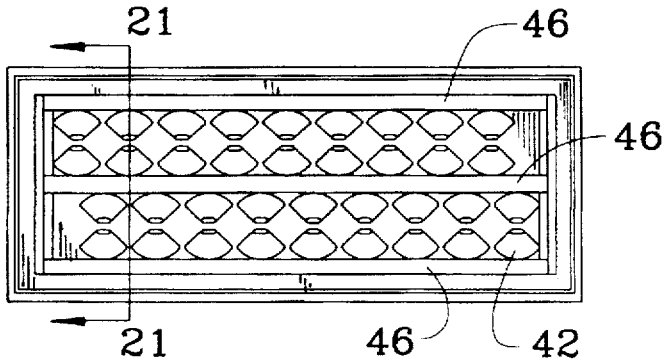
FIG. 20 is a bottom view of a secondary housing for mounting to the receptacle housing of FIG. 16.
Figure 21:
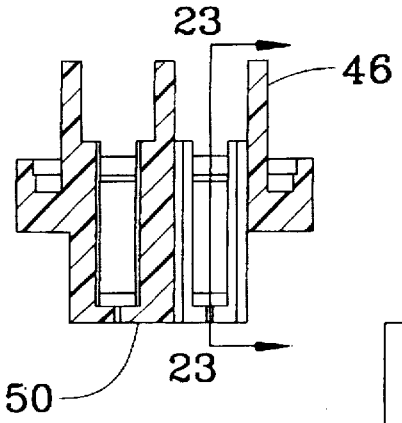
FIG. 21 is a cross-sectional view through lines 21—21 of FIG. 20.
Figure 22:
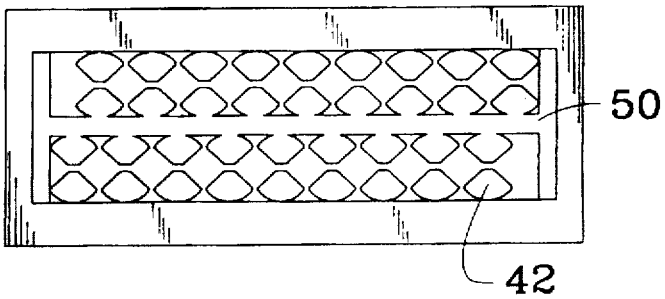
FIG. 22 is a top view of the secondary housing of FIG. 20.
Figure 23:
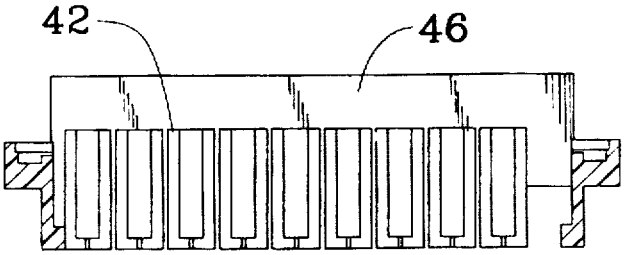
FIG. 23 is a cross-sectional view through lines 23—23 of FIG. 21.

At the position of the pin terminals, the secondary housing (see FIG. 8) comprises cavities 68 for guiding and securely holding the pins. At the position of the receptacle terminals as shown in FIG. 10, the bridging contact pins 60 are inserted into the receptacle contacts.

Referring to FIGS. 11–15, the secondary housing 16 is shown comprising the lance back-up wall 66 extending from one side and the bridging pin contact portions 58 extending from a mating side 70 of the secondary housing 16. At the position of the receptacle terminal receiving cavities 10 (see FIGS. 10 and 14) the secondary locking housing has complementary wall portions 72 that interleave between complementary wall portions 74 (see FIG. 9) for supporting the receptacle contact in an upper portion 76 (proximate the mating face) of the receptacle receiving cavities. These interleaving wall portions support the receptacle contact in a similar manner to that described for the receptacle connector 6.

The secondary housing 16 with the bridging contacts 18 is thus a single piece that can be cost effectively manufactured and assembled as a single unit to the pin connector housing 4 thereby securely locking terminals therein and simultaneously bridging some of the terminals. In the receptacle connector 6, a compact secondary housing is provided due to the interleaving of the wall portions with the connector housing wall portions such that the mating faces of the secondary locking housing and housing are flush.

Advantageously therefore, a cost effective, compact and secure connector assembly including bridging of some of the contacts is achieved.

I claim:

1. An electrical connection assembly comprising a first connector, having an insulative first housing with cavities extending therethrough from a terminal receiving face to a mating face, and terminals retained in the cavities by locking lances, the first connector further comprising a secondary locking housing mountable to the first housing and having lance back-up walls that are engageable against the locking lances when fully mounted for preventing outward biasing thereof to retain the terminals securely in the cavities, wherein bridging contacts are mounted to the secondary housing, the bridging contacts having a plurality of contact portions for short circuiting two or more terminals and wherein the bridging contacts comprise a base portion mounted in the secondary housing, and pin contacts extending in opposing directions therefrom, the pin contacts having portions extending beyond a mating side of the secondary locking housing for coupling with terminals of a second connector matable therewith.

2. The connection assembly of claim 1 wherein the bridging contacts are moulded to the secondary housing.

3. The connection assembly of claim 1 wherein the bridging contacts are stamped and formed from a sheet metal strip, which is cut to the desired length corresponding to the number of pin contacts that are desired.

4. The connection assembly of claim 1 comprising a second connector, having an insulative second housing with cavities extending therethrough from a terminal receiving face to a mating face, and terminals retained in the cavities by locking lances of the housing, the connector further comprising a secondary locking housing mountable to the second housing and having wall portions engageable against the locking lances when fully mounted for preventing outward biasing thereof to retain the terminals securely in the cavities, wherein a portion of the cavities proximate the mating face are formed by wall portions extending from the second housing and flanking the locking lances, the wall portions separated by a gap within which interleave complementary wall portions of the secondary locking housing thereby enclosing a cavity area proximate the mating face for guiding and supporting the terminals therein.

5. The connection assembly of claim 4 wherein the secondary locking housing has a mating face incorporating one end of the complementary wall portions, the mating face of the secondary locking housing being flush with the mating face of the second housing.

6. An electrical connection assembly comprising a first connector, having an insulative first housing with cavities extending therethrough from a terminal receiving face to a mating face, and terminals retained in the cavities by locking lances, the first connector further comprising a secondary locking housing mountable to the first housing and having lance back-up walls that are engageable against the locking lances when fully mounted for preventing outward biasing thereof to retain the terminals securely in the cavities, wherein bridging contacts are mounted to the secondary housing, the bridging contacts having a plurality of contact portions for short circuiting two or more terminals, the assembly further comprising a second connector, having an insulative second housing with cavities extending therethrough from a terminal receiving face to a mating face, and terminals retained in the cavities by locking lances of the housing, the connector further comprising a secondary locking housing mountable to the second housing and having wall portions engageable against the locking lances when fully mounted for preventing outward biasing thereof to retain the terminals securely in the cavities, and wherein a portion of the cavities proximate the mating face are formed by wall portions extending from the second housing and flanking the locking lances, the wall portions separated by a gap within which interleave complementary wall portions of the secondary locking housing thereby enclosing a cavity area proximate the mating face for guiding and supporting the terminals therein.

7. The connection assembly of claim 6 wherein the secondary locking housing has a mating face incorporating one end of the complementary wall portions, the mating face of the secondary locking housing being flush with the mating face of the second housing.

* * * * *